US006778005B2

(12) United States Patent
Fujiwara et al.

(10) Patent No.: US 6,778,005 B2
(45) Date of Patent: Aug. 17, 2004

(54) HIGH PSRR CURRENT SOURCE

(75) Inventors: Futoshi Fujiwara, Tokyo (JP); Akihiko Miyanohara, Tokyo (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/330,818

(22) Filed: Dec. 27, 2002

(65) Prior Publication Data

US 2003/0169099 A1 Sep. 11, 2003

(Under 37 CFR 1.47)

Related U.S. Application Data

(60) Provisional application No. 60/350,616, filed on Jan. 22, 2002.

(51) Int. Cl.[7] ..... G05F 1/10

(52) U.S. Cl. ..... 327/538; 327/427

(58) Field of Search ..... 327/538–540, 327/541, 545, 427, 72.73, 581, 311; 323/312, 313, 315, 316

(56) References Cited

U.S. PATENT DOCUMENTS 5,373,226 A * 12/1994 Kimura ..... 323/313
6,255,897 B1 * 7/2001 Klemmer ..... 327/538
6,509,727 B2 * 1/2003 Fahrenbruch ..... 323/316

* cited by examiner

*Primary Examiner*—Long Nguyen
(74) *Attorney, Agent, or Firm*—W. Daniel Swayze, Jr.; W. James Brady; Frederick J. Telecky, Jr.

(57) ABSTRACT

The present invention improves on the topology of a conventional current source by interposing an RC circuit and additional MOS between the output of a buffer and the output of the current source. The topology of the present invention advantageously provides a clean current output by shunting noise to ground.

10 Claims, 1 Drawing Sheet

HIGH PSRR CURRENT SOURCE

CROSS REFERENCE TO RELATED APPLICATIONS

This application is related to and claims priority of U.S. Provisional Patent Application No. 60/350,616 filed on Jan. 22, 2002 entitled "High PSRR Current Source," and the teachings are incorporated herein by reference.

FIELD OF THE INVENTION

This invention relates to current sources, and in particular, current sources capable of providing a high power supply rejection ratio ("PSRR").

BACKGROUND OF THE INVENTION

PSRR refers to the change in input offset voltage of an operational amplifier ("op-amp") to the change in the power supply voltage that causes it. The offset voltage refers to the difference in voltage at the two inputs of an op-amp required to bring the output voltage to zero.

SUMMARY OF THE INVENTION

The present invention improves on the topology of a conventional current source by interposing an RC circuit and additional MOS between the output of the buffer and the output of the current source. The topology of the present invention advantageously provides a clean current output by shunting noise to ground.

BRIEF DESCRIPTION OF THE DRAWINGS

For a more complete understanding of the present invention, reference is made to the following detailed description taken in conjunction with the accompanying drawings wherein.

DETAILED DESCRIPTION OF THE INVENTION

The numerous innovative teachings of the present application will be described with particular reference to the disclosed embodiment. However, it should be understood that this embodiment provides only one example of the many advantageous uses and innovative teachings herein. In general, statements made in the specification of the present application do not necessarily delimit any of the various claimed inventions. Moreover, some statements may apply to some inventive features, but not to others. Detailed descriptions of known functions and constructions unnecessarily obscuring the subject matter of the present invention have been omitted for clarity. Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

Figure 1:
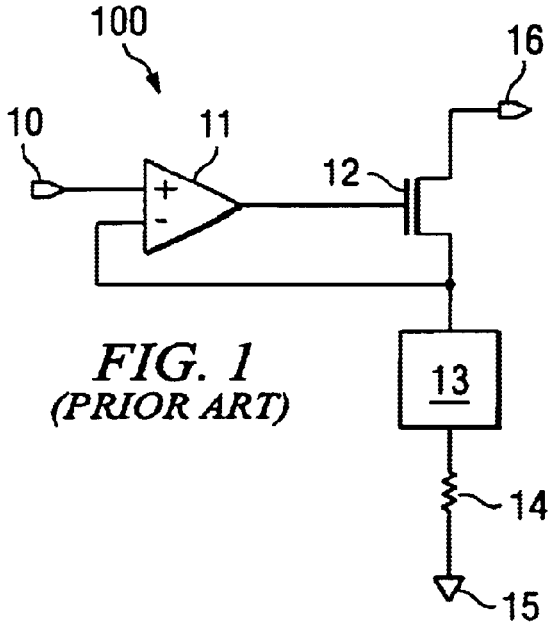
FIG. 1 (PRIOR ART)
FIG. 1 is a schematic circuit diagram of a conventional current source using a CMOS device.

A conventional current source 100 is illustrated in FIG. 1. It comprises a reference voltage input 10 coupled to the non-inverting input of buffer 11. The output of buffer 11 is coupled to the gate of MOS transistor 12. The drain of MOS transistor being coupled to the inverting input of the buffer

11 and to pin 13. An external resistor 14 couples the current generator 100 to ground 15. The source of MOS transistor 12 is coupled to output pin 16. Disadvantageously, current generator 100 is unable to shunt noise to ground 15 and thus, noise is outputted at pin 16 with the current signal.

Figure 2:
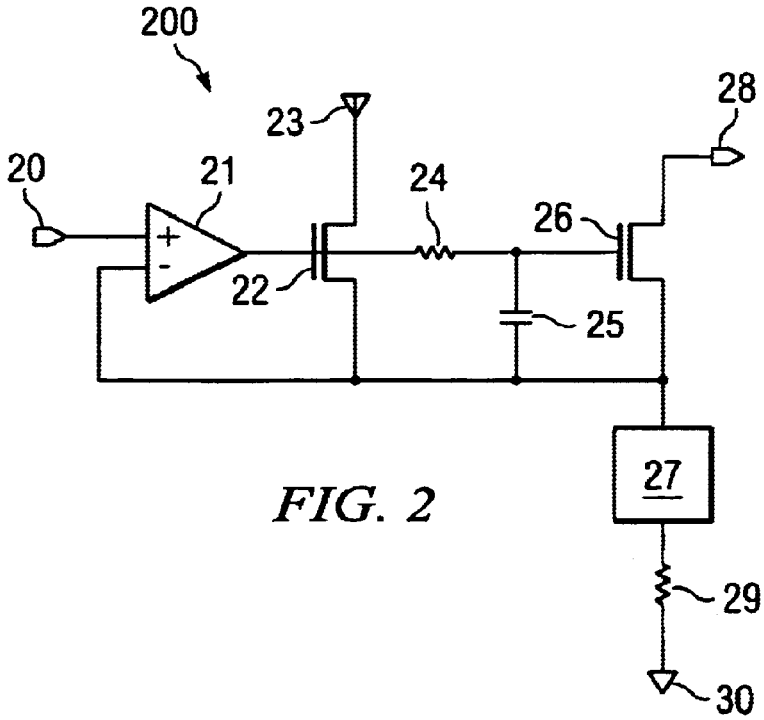
FIG. 2 is a schematic circuit diagram of a current source using a CMOS device of the present invention.

An embodiment of the present invention is disclosed as current source 200 in FIG. 2. As seen therein, current source 200 comprises a voltage reference input terminal 20 coupled to the non-inverting input of buffer 21. In the disclosed embodiment, buffer 21 comprises an operational amplifier buffer. The output of buffer 21 is coupled to the gate of first MOS transistor 22. The source of first MOS transistor 22 is coupled to first pin 23. The drain of first MOS transistor 22 is coupled to the inverting input of buffer 21. The first terminal of first resistor 24 is coupled to the gate of first MOS transistor 22. The second terminal of first resistor 24 is coupled to the gate of second MOS transistor 26. The first terminal of capacitor 25 is coupled to the gate of the second MOS transistor 26 and the second terminal of capacitor 25 is coupled to the inverting input of buffer 21. The drain of second MOS transistor 26 is coupled to second pin 27 and the source of the second MOS transistor 26 is coupled to output terminal 28. In the disclosed embodiment of the present invention, the first MOS transistor 22 comprises a PMOS transistor and second MOS transistor 26 comprises an NMOS transistor. As shown in the disclosed embodiment, the second pin 27 is coupled to a first terminal of second resistor 29 and the second terminal of second resistor 29 is coupled to ground 30. As shown, the second resistor 29 is external to current source 200.

Advantageously, current source 200 is operable to shunt noise to ground 30 and a cleaned current signal to output terminal 28.

Although a disclosed embodiment of the present invention has been illustrated in FIG. 2 and described in the foregoing Detailed Description, it is understood that the invention is not limited to the embodiment disclosed, but is capable of numerous rearrangements, modifications, and substitutions without departing from the spirit of the invention as set forth and defined by the following claims.

What is claimed is:

1. A current source, comprising:

a buffer;

an input terminal coupled to a non-inverting input of the buffer;

a first MOS transistor;

an output of the buffer being coupled to the gate of the first MOS transistor;

an input pin;

the source of the first MOS transistor coupled to the input pin;

the drain of the first MOS transistor being coupled to an inverting input of the buffer;

a first resistor;

the first terminal of the first resistor being coupled to the gate of the first MOS transistor;

a second MOS transistor;

the second terminal of the first resistor being coupled to the gate of the second MOS transistor;

a capacitor;

the first terminal of the capacitor also being coupled to the gate of the second MOS transistor;

the second terminal of the capacitor also being coupled to the inverting input of the buffer;

the drain of the second MOS transistor being coupled to a ground pin; and the source of the second MOS transistor being coupled to an output terminal.

2. The current source of claim 1, wherein the buffer comprises an op-amp buffer.

3. The current source of claim 1, wherein the first MOS transistor comprises a PMOS transistor.

4. The current source of claim 1, wherein the second MOS transistor comprises an NMOS transistor.

5. The current source of claim 1, wherein the input terminal receives a voltage reference input signal.

6. The current source of claim 1, adapted for use in a power supply circuit.

7. The current source of claim 1, adapted for use in an integrated circuit.

8. The current source of claim 1, further comprising:

a second resistor;

the ground pin being coupled to a first terminal of the second resistor; and the second terminal of the second resistor being coupled to ground.

9. The current source of claim 8, wherein the second resistor is external to the remainder of the current source circuit.

10. The current source of claim 8, operated to shunt noise to ground and to provide a cleaned, signal to the output terminal.

* * * * *